US005136944A

United States Patent [19]

Gustafson et al.

[11] Patent Number: 5,136,944

[45] Date of Patent: Aug. 11, 1992

[54] TICKET DISPENSING MECHANISM

[75] Inventors: William C. Gustafson, Moscow; Thad C. Brinkley, Lewiston, both of Id.

[73] Assignee: Moscow Electronics Company, Moscow, Id.

[21] Appl. No.: 588,362

[22] Filed: Sep. 26, 1990

[51] Int. Cl.[5] ..... B41F 13/54; B65H 20/00

[52] U.S. Cl. ..... 101/228; 226/187; 226/188

[58] Field of Search ..... 101/228, 288, 219; 226/187, 188

[56] References Cited

U.S. PATENT DOCUMENTS

| | | | |
|---|---|---|---|
| 4,272,001 | 6/1981 | Horniak | 226/187 |
| 4,475,457 | 10/1984 | Davison | 101/228 |
| 4,579,269 | 4/1986 | Lasley | 226/188 |
| 4,716,799 | 1/1988 | Hartmann | 83/42 |

OTHER PUBLICATIONS

Brochure: Deltronic Labs Inc., "Ticket Dispenser", Model DL-1275.

*Primary Examiner*—Edgar S. Burr
*Assistant Examiner*—Moshe I. Cohen
*Attorney, Agent, or Firm*—Limbach & Limbach

[57] ABSTRACT

A ticket dispensing mechanism is disclosed having a housing, a worm and drive, an idler roller, and a drive roller that engages the worm. Rotating the worm rotates the drive roller to advance a strip of tickets placed between the drive roller and the idler roller. A sensor detects ticket movement and a control circuit controls the worm drive motor to rotate the worm until the appropriate number of tickets have been dispensed. A slotted mounting for the drive roller accommodates tickets of different thickness, and locks the tickets against unauthorized withdrawal.

8 Claims, 2 Drawing Sheets

TICKET DISPENSING MECHANISM

BACKGROUND OF THE INVENTION

This invention relates to mechanisms for dispensing tickets in a serial fashion.

Ticket dispensing mechanisms are used in a variety of applications. In the arcade gaming industry, for example, there is a trend toward expanding the use of redemptive games. These are games of skill that pay off in terms of tickets that can be redeemed for merchandise. Such games use ticket dispensing mechanisms to dispense the appropriate number of tickets. Tickets are dispensed under the control of a controlling device coupled to the game that determines the number of tickets to be issued. Tickets are typically handled in the form of a continuous roll or strip of tickets, with perforations or notches between the tickets.

Ticket dispensing mechanisms should provide means for validating tickets by placing some form of easily identifiable mark on the tickets to prove that they were dispensed by the mechanism. Validation prevents customers from redeeming tickets obtained from any source other than the dispensing mechanism.

Ticket dispensing mechanisms should also provide a locking means to block the withdrawal of unearned tickets by a customer. Otherwise, the customer could simply pull on the tickets protruding from the mechanism and obtain more tickets than he is entitled to.

SUMMARY OF THE INVENTION

In accordance with the illustrated preferred embodiment, the present invention is a ticket dispensing mechanism having a housing, a worm and drive motor, an idler roller, and a drive roller including a worm gear that engages the worm. Rotating the worm rotates the drive roller to advance a strip of tickets (or other material in strip form) placed between the drive roller and the idler roller. A sensor detects ticket movement and a control circuit controls the worm drive motor to rotate the worm and engaged worm gear until the appropriate number of tickets (or length of material) have been dispensed. A slotted mounting for the drive roller accommodates tickets of different thickness, and locks the tickets against unauthorized withdrawal.

Ticket validation is provided by the idler roller contacting the strip of tickets as the drive roller is rotated. An optional inking roller transfers ink to the idler roller, which in turn transfers the ink to the ticket as it is dispensed.

The ticket dispensing mechanism of the present invention locks the strip of tickets against unauthorized withdrawal. The drive roller engages the worm and cannot rotate except when driven by the worm. If a customer pulls on the strip of tickets, the drag of the tickets moves the drive roller toward the idler roller, thereby pinching the strip of tickets between the two rollers and locking the tickets in place. The slotted mounting of the drive roller shaft allows this movement of the drive roller. When the pull on the tickets is released and the worm drive is energized, the worm moves the drive roller back to its normal position, releasing the pinching action against the idler roller.

The ticket dispensing mechanism of the present invention is low in cost due to its simplicity and use of few components. It is also simple to service and replace strips of tickets. The ticket dispensing mechanism is essentially jam-proof because the drive roller will slip against the strip of tickets if the tickets do not advance.

The features and advantages described in the specification are not all inclusive, and particularly, many additional features and advantages will be apparent to one of ordinary skill in the art in view of the drawings, specification and claims hereof. Moreover, it should be noted that the language used in the specification has been principally selected for readability and instructional purposes, and may not have been selected to delineate or circumscribe the inventive subject matter, resort to the claims being necessary to determine such inventive subject matter.

DETAILED DESCRIPTION OF THE PREFERRED EMBODIMENT

FIG. 1 through 4 of the drawings depict two preferred embodiments of the present invention for purposes of illustration only. One skilled in the art will readily recognize from the following discussion that alternative embodiments of the structures and methods illustrated herein may be employed without departing from the principles of the invention described herein.

Figure 1:
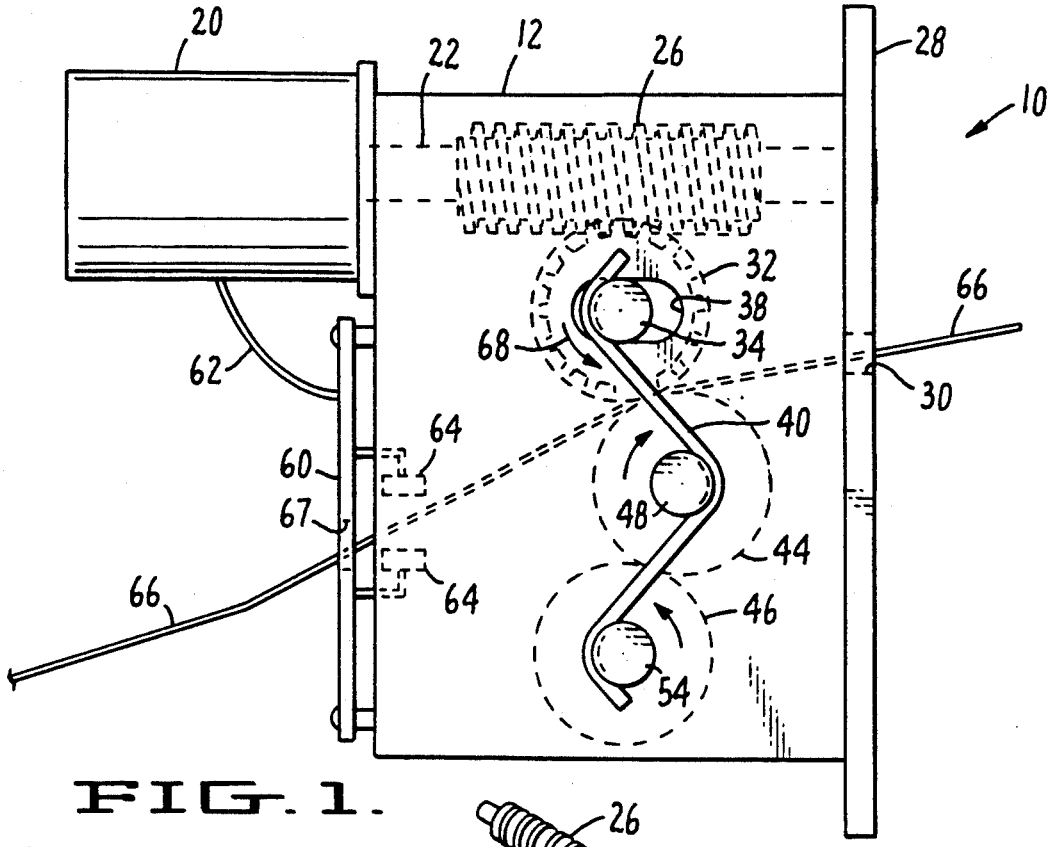
FIG. 1 is a side view of a ticket dispensing mechanism according to the present invention.
Figure 2:
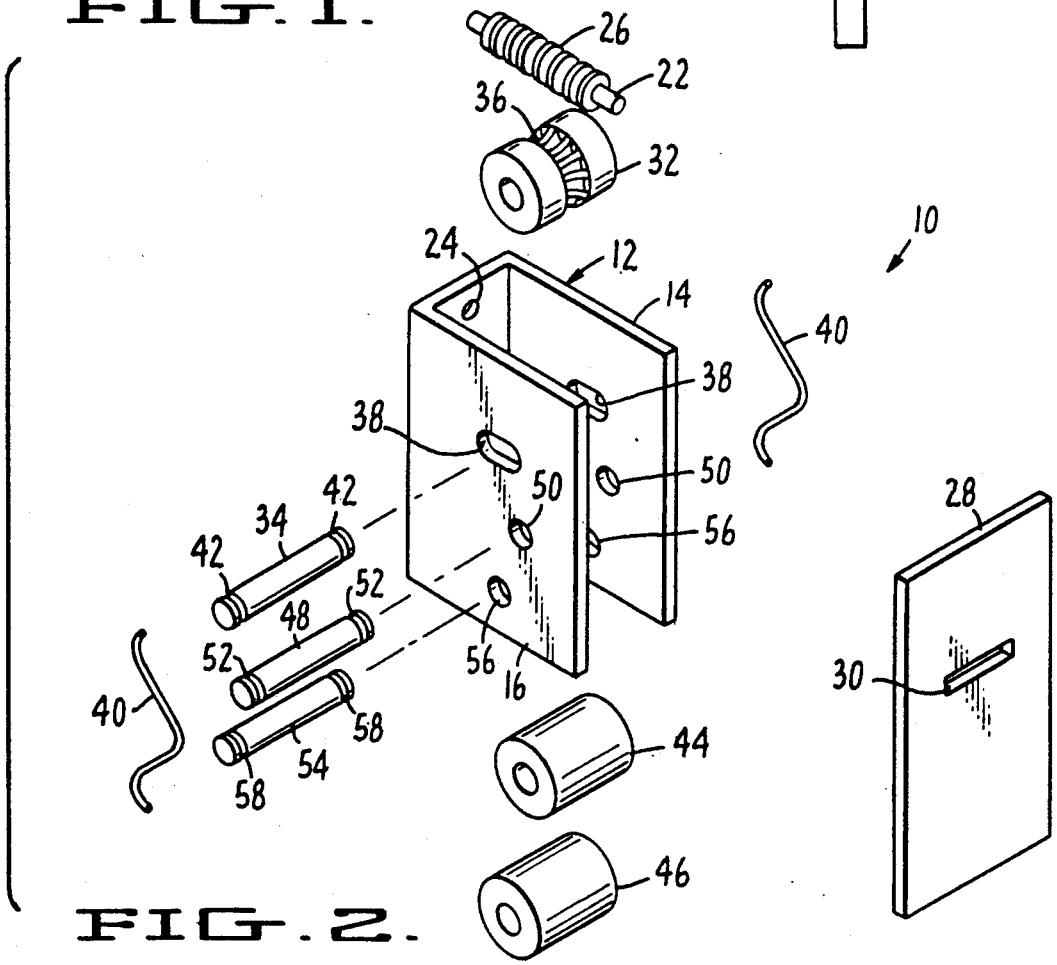
FIG. 2 is an exploded, perspective view of the ticket dispensing mechanism according to the present invention.

One embodiment of the present invention is the ticket dispensing mechanism 10 shown in FIGS. 1 and 2. The ticket dispensing mechanism 10 includes a housing 12 that is preferably a "U" shaped piece of metal with two parallel side plates 14 and 16 and an end plate 18. The housing 12 can be fabricated from a flat, rectangular piece of metal by punching mounting holes (described below) and forming two right angle bends.

An electric motor 20 is mounted to the rear of the end plate 18 and drives a shaft 22 that project into the space between the two side plates 14 and 16 through a hole 24 in the end plate 18. A worm 26 is attached to the shaft 22. A face plate 28 is fastened to the housing 12 opposite the end plate 18 by fasteners or other means (not shown). The end of the worm shaft 22 opposite the motor 20 is supported by the face plate 28. The face plate 28 includes an exit slot 30 through which tickets are dispensed to customers.

A drive roller 32 is mounted below the worm 26 for rotation on a shaft 34. The drive roller includes a gear 36, cut into its cylindrical face, that meshes with the worm 26. The drive roller shaft 34 extends through two slotted holes 38 in the two side plates 14 and 16 of the housing 12. The shaft 34 is retained by two spring clips 40 that engage grooves 42 cut into each end of the shaft.

Below the drive roller 32 are mounted an idler roller 44 and an inking roller 46. The idler roller 44 is mounted for rotation about a shaft 48 that extends through two holes 50 in the side plates 14 and 16 and is retained by the spring clips 40 that engage grooves 52 at the ends of the shaft 48. Likewise, the inking roller 46 is mounted for rotation about a shaft 54 that extends through two holes 56 in the side plates 14 and 16 and is retained by the spring clips 40 that engage grooves 58 at the ends of the shaft 54. The idler roller 44 and inking roller 46 are mounted so that the cylindrical surfaces of the two rollers are in contact. The spring clips 40 bias the drive roller shaft 34 to the front of the mechanism (to the right, as viewed in FIG. 1), ensuring contact between the cylindrical faces of drive roller 32 and idler roller 44.

Mounted to the end plate 18 is a circuit board 60 that contains electronic circuitry that controls the operation of the ticket dispensing mechanism. The circuit board 60 is wired to the electric motor 20 through a cable 62. An optical sensor 64 is mounted to the circuit board 60 and extends inside of the housing 12. A strip of tickets 66 is fed through a slot 67 in the circuit board 60, past the optical sensor 64, between the drive roller 32 and idler roller 44, and out through the exit slot 30 in the face plate 28. A supply of tickets (not shown) is located to the left of FIG. 1. The optical sensor 64 is capable of sensing notches or holes between the tickets.

When the electronic circuitry located on the circuit board 60 is directed to dispense one or more tickets, it energizes the motor 20, which turns the worm 26. This causes the drive roller 32 to rotate as shown by arrow 68 in FIG. 1 and advance the strip of tickets 66 toward the exit slot 30. The motor 20 continues to turn the worm 26 and drive roller 32 until the optical sensor 64 and associated control circuitry detect that the appropriate number of tickets has been advanced. At that point, the motor 20 is halted, thereby stopping the worm 26 and drive roller 32, and halting the advance of the strip of tickets 66.

Ticket validation is achieved by printing characters or other special marks on the tickets as they advance through the rollers. These characters or marks are located on the cylindrical surface of the idler roller 44 and are transferred to the tickets as the idler roller rotates. The idler roller 44 drives the inking roller 46, which transfers ink or other marking substance to the idler roller.

Locking the tickets against unauthorized withdrawal is accomplished by the mounting of the drive roller shaft 42. The slotted holes 38 allow the drive roller 32 to move laterally, while the two spring clips 40 bias the drive roller 32 toward contact with the idler roller 44. The drive roller 32 is positioned relative to the idler roller 44 so that the space between the two rollers decreases as the drive roller moves toward the ticket exit slot 30. If a customer pulls on the tickets at the ticket exit 30, the drive roller 32 is pulled along the mounting slots 38 in the same direction. Pulling the tickets will not rotate the worm 26. Instead, the worm remains stationary, locking the upper portion of the drive roller 32 that engages the worm. Pulling on the strip of tickets will cause the drive roller 32 to pivot about the worm, with the lower portion of the drive roller moving toward the ticket exit slot 30. This movement decreases the clearance between the drive roller 32 and idler roller 44 to the point where the rollers pinch the strip of tickets between them, thereby preventing the customer from forcefully withdrawing unearned tickets. Once the pull at the ticket exit is released, the worm can turn the drive roller 32, which moves the drive roller away from the ticket exit slot 30 and releases the pinch on the tickets.

In effect, the spring clips 40 and mounting slots 38 allow self-alignment of the drive roller 32 relative to the idler roller 44 and tickets 66. Driving the drive roller 32 with the worm 26 pulls the drive roller back against the spring clips 40 only enough to allow the tickets to advance. This self-alignment arrangement of the two rollers also provides a simple method of accommodating thickness variations between strips of tickets.

The initial loading of tickets is accomplished by moving the drive roller to the left, as viewed in FIG. 1, and feeding the strip of tickets between the drive roller and idler roller. Once the tickets are in place, the drive roller is released and the spring clips 40 move the drive roller back to the right, thus capturing the tickets between the drive roller and idler roller.

Figure 3:
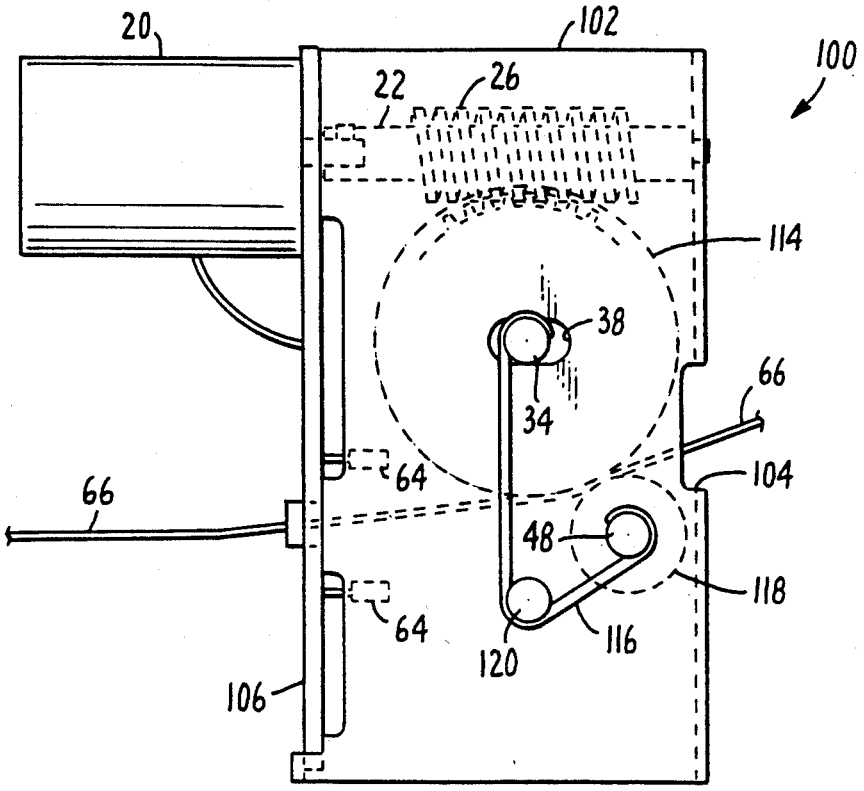
FIG. 3 is a side view of an alternative and preferred embodiment of the ticket dispensing mechanism according to the present invention.
Figure 4:
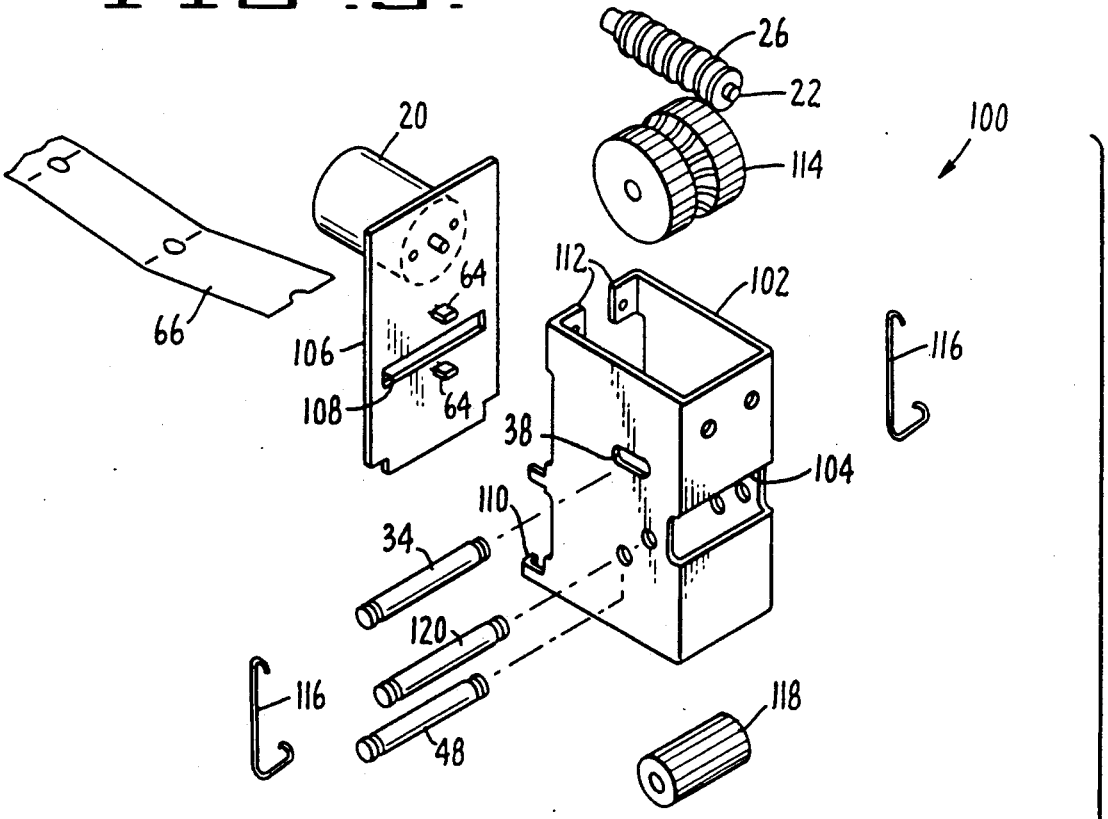
FIG. 4 is an exploded, perspective view of the ticket dispensing mechanism of FIG. 3.

Another embodiment of the present invention is the ticket dispensing mechanism 100 shown in FIGS. 3 and 4. Components similar to those shown in FIGS. 1 and 2 and described above are labeled with the same reference numerals as before.

In this embodiment, the housing 102 is turned around, with an open end facing the entry side of the tickets 66. The exit side of the housing 102 includes a slot 104 through which tickets exit the dispensing mechanism. The motor 20 is mounted to a printed circuit board 106, which includes a slot 108 for the entry of the tickets into the dispensing mechanism. The printed circuit board 106 is retained on the housing 102 by lower tabs 110 and is fastened to upper tabs 112 with screws, not shown.

The worm 26 engages a drive roller 114 that is mounted on shaft 34 and is retained by spring clips 116. An idler roller 118 is mounted on shaft 48 and is also retained by the spring clips 116. A third shaft 120 is also retained by the spring clips. The cylindrical surfaces of the drive roller 114 and idler roller 118 that contact the tickets are knurled. Shaft 120 is located in such a position as to provide a pivot point for the two springs 116 so that the spring force is applied to the drive roller 114 in a direction that is approximately parallel to the axis of the worm 26 and towards the ticket exit 104.

In comparison with the ticket dispensing mechanism 10 shown in FIGS. 1 and 2, the ticket dispensing mechanism 100 has a larger drive roller 114 and smaller idler roller 118, but operates in the same manner. The spring clips 116 apply a bias force to the drive roller shaft 38 in a direction toward the exit end of the housing, holding the strip of tickets 66 between the drive roller and idler roller 118. A pull on the tickets causes the drive roller shaft 34 to move toward the exit, with the bottom of the drive roller pinching the tickets against the idler roller and locking the tickets in place. Rotating the worm 26 thereafter releases the pinch by moving the drive roller back against bias force of the spring clips 116, allowing the drive and idler rollers to rotate and feed the strip of tickets toward the exit.

From the above description, it will be apparent that the invention disclosed herein provides a novel and advantageous ticket dispensing mechanism. The foregoing discussion discloses and describes merely exemplary methods and embodiments of the present invention. As will be understood by those familiar with the art, the invention may be embodied in other specific forms without departing from the spirit or essential characteristics thereof. For example, the material dispensed by the present invention need not be tickets, but could be any material that is dispensed in tape or strip form. Also, the orientation of the ticket dispensor is not important since gravity does not place a significant role in the operation of the device. Accordingly, the disclosure of the present invention is intended to be illustrative, but not limiting, of the scope of the invention, which is set forth in the following claims.

What is claimed is:

1. An apparatus for dispensing one or more tickets from a strip of tickets, said apparatus comprising:

a housing;

a worm and associated drive means mounted to the housing for rotating the worm;

a drive roller and associated mounting means for mounting the drive roller to the housing for rotation on an axis transverse to the axis of the worm and said associated mounting means including means for mounting the axis of the drive roller for translation in a direction substantially parallel to the axis of the worm, the drive roller including a gear in engagement with the worm for rotating the drive roller responsive to rotation of the worm;

an idler roller mounted to the housing for rotation on an axis parallel to that of the drive roller and mounted at a position adjacent to the drive roller opposite the worm; and bias means for biasing the drive roller toward the idler roller, wherein a strip of tickets placed between the drive roller and the idler roller is advanced by rotating the worm and drive roller.

2. An apparatus as recited in claim 1 wherein the drive roller and idler roller are mounted on shafts and wherein the bias means includes two springs engaging the outer ends of the shafts.

3. An apparatus as recited in claim 1 wherein the housing includes two parallel plates, wherein the worm, drive roller, and idler rollers are located between the plates of the housing, and wherein the drive roller and idler roller are mounted on shafts that are mounted through holes in the housing.

4. An apparatus as recited in claim 3 wherein the shaft of the drive roller is mounted to the housing through two elongated slots and wherein the shaft of the drive roller is retained by two springs that engage the outer ends of the shaft and bias the shaft toward the idler roller.

5. An apparatus as recited in claim 1 wherein the gear of the drive roller is centered between the ends of the drive roller and is recessed below the cylindrical surface of the drive roller.

6. An apparatus as recited in claim 1 further comprising means for marking the tickets as they pass between the drive roller and the idler roller.

7. An apparatus as recited in claim 6 wherein said means for marking the tickets includes an inking roller that transfers ink to the idler roller, which in turn transfers the ink to the tickets as they contact the idler roller.

8. An apparatus for dispensing material from a strip of material, said apparatus comprising:

a housing including two parallel plates said plates each having a slot and a hole therein;

a worm and associated drive means mounted to the housing for rotating the worm;

a first shaft slidably mounted to the housing through said slots in the parallel plates of the housing, wherein the slots extend in a direction substantially parallel to the axis of the worm;

a drive roller rotatably mounted to the first shaft and including a gear that engages the worm for rotating the drive roller when the worm is rotated;

a second shaft;

an idler roller rotatably mounted to said second shaft that extends through said holes in the plates of the housing, wherein the idler roller is mounted at a position adjacent to the drive roller opposite the worm;

two springs engaging the outer ends of the first and second shafts and biasing the drive roller toward the idler roller, wherein a strip of material placed between the drive roller and the idler roller is advanced by rotating the worm and drive roller; and control means for controlling the worm and drive means to advance the worm by a number of rotations sufficient to cause the drive roller to advance the strip of material by a desired amount.

* * * * *